US005741152A

United States Patent [19]

Boutros

[11] Patent Number: 5,741,152

[45] Date of Patent: Apr. 21, 1998

[54] ELECTRICAL CONNECTOR WITH INDICATOR LIGHTS

[75] Inventor: Kamal Shawiky Boutros, Richmond Hill, Canada

[73] Assignee: Amphenol Corporation, Wallingford, Conn.

[21] Appl. No.: 428,697

[22] Filed: Apr. 25, 1995

[51] Int. Cl.[6] ..... H01R 13/00

[52] U.S. Cl. ..... 439/490; 439/910

[58] Field of Search ..... 439/489, 490, 439/571, 572, 573, 676, 357, 358, 577, 910

[56] References Cited

U.S. PATENT DOCUMENTS

| | | | |
|---|---|---|---|
| 1,720,463 | 7/1929 | Both . | |
| 2,474,407 | 6/1949 | Todd et al. | 177/311 |
| 2,503,677 | 4/1950 | McHenry et al. | 177/311 |
| 3,265,888 | 8/1966 | Adolphson | 240/73 |
| 3,500,293 | 3/1970 | Cocco | 439/490 |
| 3,753,261 | 8/1973 | Thaxton | 340/252 P |
| 4,379,606 | 4/1983 | Clark et al. | 439/76.1 |
| 4,386,818 | 6/1983 | Millhimes et al. | 439/490 |
| 4,397,513 | 8/1983 | Clark et al. | 439/357 |
| 4,727,648 | 3/1988 | Savage, Jr. | 29/839 |
| 4,843,326 | 6/1989 | Smythe | 324/503 |
| 4,978,317 | 12/1990 | Pocrass | 439/490 |
| 5,062,807 | 11/1991 | Guss, III | 439/490 |
| 5,125,054 | 6/1992 | Ackley et al. | 385/49 |
| 5,169,329 | 12/1992 | Taguchi | 439/188 |
| 5,320,560 | 6/1994 | Fladung | 439/490 |

FOREIGN PATENT DOCUMENTS

| | | |
|---|---|---|
| 3005 652 B1 | 2/1980 | Germany . |
| 3637191 C1 | 10/1986 | Germany . |
| 2 070 868 A | 2/1981 | United Kingdom . |

*Primary Examiner*—Hien Vu
*Attorney, Agent, or Firm*—Bacon & Thomas

[57] ABSTRACT

An electrical connector which includes a built-in indicator light arrangement is arranged such that the light source is positioned away from the front face of the connector through which the light is to be viewed, the light being directed from the light source to the front face by a light guide, which can either be formed by making the connector itself of a transparent material and including light reflecting or refracting surfaces as needed to direct the light to the front face of the connector, or by including a discrete waveguide placed in a passage which extends from the indicator light-containing cavity to the front face of the connector, and which includes appropriate light reflecting or refracting surfaces.

7 Claims, 1 Drawing Sheet

ELECTRICAL CONNECTOR WITH INDICATOR LIGHTS

BACKGROUND OF THE INVENTION

1. Field of the Invention

This invention relates to an electrical connector having integral or built-in indicator lights, and more particularly to an electrical connector which can accommodate relatively large indicator lights in a limited space.

2. Description of Related Art

Electrical connectors having built-in indicator lights are known from U.S. Pat. No. 4,978,317 and U.S. patent application Ser. No. 08/422,865, filed Apr. 17, 1995. In each of these connectors, the indicator light is situated at the front of the connector, in the narrow space between the mating connector opening and the top or bottom and sides of the connector. Because the connectors in question, typically telephone jack or "RJ"-type connectors, are generally limited to predetermined dimensions, and because these connectors were not initially designed to accommodate lights or other components at the front of the connector, the available space is very small, and thus the indicator lights are also limited in size and power. In addition, placement of the indicator lights at the front of the connector presents the problem that the lead wires for the indicator lights must be run through the connector and bent at a ninety degree angle in order to reach the circuit board to which they are to be connected, making installation of the lights in the connector difficult.

In the connector illustrated in U.S. patent application Ser. No. 08/422,865, and also in the present invention, the indicator lights are used for the purpose of testing circuits on a network or communications interface card on which the connector is installed. In general, at least two such lights are required, compounding the problem of lack of space at the front of the connector, and making assembly even more difficult than if only a single light were required.

In many connectors, particularly telephone jack connectors, the space available at the sides and rear of the connector is larger than the space available at the front of the connector. However, when installed on an interface or network card which has been inserted into an expansion slot of a computer, the only visible portion of the connector is the front face, and thus the indicator lights must be visible at the front of the connector, which is why all previous designs have attempted to fit the indicator light at or on the front face of the connector in the space surrounding the opening which receives the mating connector. The present invention, in contrast, uses the available space at the rear or sides of the connector to accommodate the indicator light or lights, greatly simplifying assembly and allowing larger and brighter lights to be used.

SUMMARY OF THE INVENTION

It is accordingly an objective of the invention to provide an indicator light arrangement for a connector in which the indicator lights are visible at the front of the connector and yet in which the size of the indicator lights is not limited by the available space at the front of the connector.

It is a further of objective of the invention to provide an indicator light arrangement for a standard profile connector, and in particular a telephone jack or RJ connector, in which assembly of the lights to the connector is facilitated by providing additional space for the indicator lights and by not requiring that the lead wires for the indicator lights be bent at a ninety degree angle in order to reach the circuit board.

It is more generally an objective of the invention to provide an indicator light arrangement for a connector in which the indicator light is provided in a larger portion of the connector than the area from which the indicator light must be visible, and in which the indicator lights are vertically rather than horizontally positioned.

These objectives are achieved, according to a first preferred embodiment of the invention, by providing a connector made of a transparent material in which a portion of the connector forms a light guide for transmitting light from the indicator light to the face at which the light is visible, the face being remote from the indicator light.

The objectives of the invention are also achieved, according to the principles of a second preferred embodiment of the invention, by providing an indicator light arrangement for a connector in which the connector includes a discrete waveguide for transmitting light from an indicator light in the connector to a face from which the indicator light is visible, the face being remote from the indicator lights.

In both of the preferred embodiments of the invention, the connectors may be in the form of an RJ connector, for example a high speed RJ-45 connector of the type typically used on network or communications interface cards, the face of the connector from which the lights are used being the front face of the connector, i.e., the side of the connector through which the mating RJ plug connector is inserted, with the indicator lights being positioned at the rear of the connector. Also, in each of the preferred embodiments, the indicator lights are in the form of LEDs, although the principles of the invention permit other types of lighting to be used.

DETAILED DESCRIPTION OF THE PREFERRED EMBODIMENTS

Figure 2:
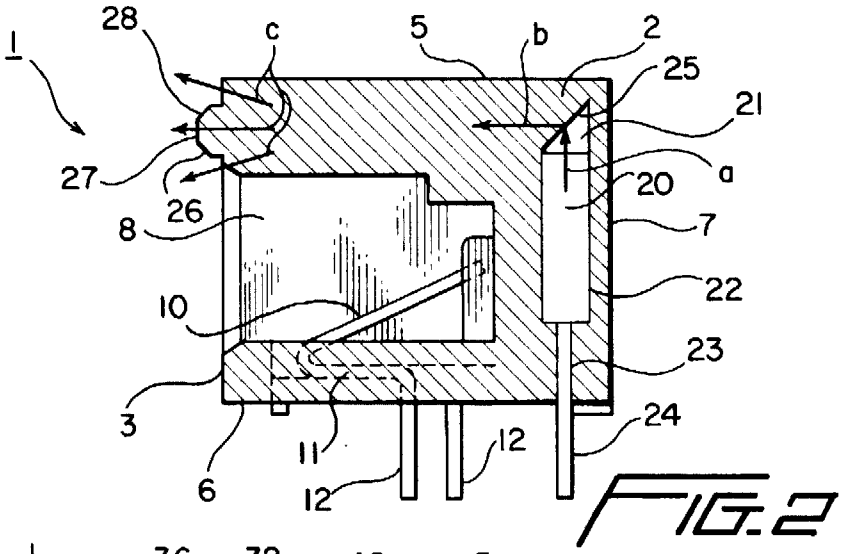
FIG. 2 is a cross-sectional side view of the connector shown in FIG. 1.

The connectors of the two preferred embodiments of the invention, illustrated respectively in FIGS. 1 and 2 and FIGS. 3 and 4 have in common that each is an RJ-type telephone jack connector 1 having, as is conventional, a molded plastic housing 2 which includes a front face 3, sidewalls 4, a top wall 5, a bottom surface 6 arranged to be seated on a circuit card, a rear wall 7, a plug insertion opening 8, and a plurality of contacts, each having a mating portion 10 extending into the plug insertion opening 8 for mating with corresponding contacts on a mating plug, a horizontal portion 11 extending through a passage in the lower portion of the connector below the plug insertion opening, and a downwardly extending portion 12 extending from the lower surface 6 of the connector for insertion into openings in the circuit board (not shown) on which the connector is mounted. The downwardly extending portions 12 of the multiple connector contacts are generally arranged in two rows as illustrated.

Those skilled in the art will appreciate that, while each of these components is standard, they may nevertheless be varied in numerous ways, and that the principles of the invention can be adapted to a wide variety of connector configurations, including RJ connectors in which portions 10 of the contacts extend downwardly from the top surface of opening 8 rather than upwardly from the lower surface of opening 8 as illustrated, RJ connectors having surface mount contacts, RJ filter connectors, and non-RJ connectors.

Figure 1:
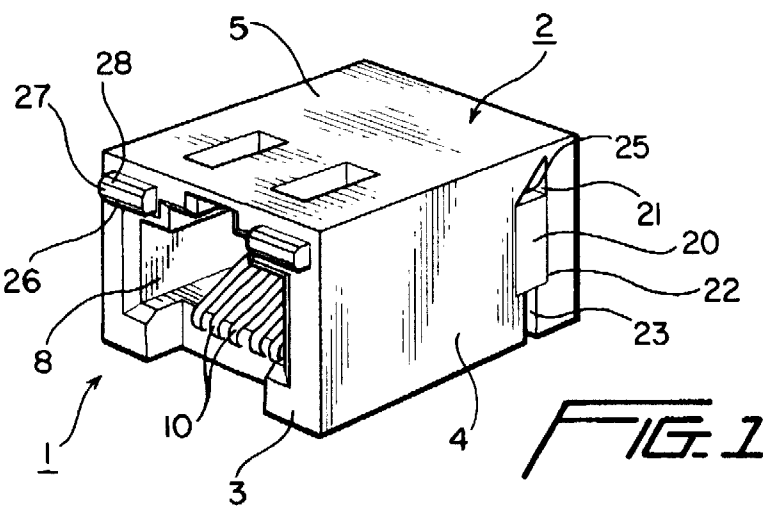
FIG. 1 is a perspective view of an RJ connector made of a transparent material according to a first preferred embodiment of the invention.

In the embodiment of the invention illustrated in FIGS. 1 and 2, the connector housing 1 is made of a clear plastic material. Examples of suitable materials are commercially available and can easily be substituted during the molding process for the opaque plastic materials currently used. The use of a clear or transparent material for the connector body not only facilitates the lighting arrangement, as will be discussed below, but also may enhance the attractiveness of the connector.

The lighting arrangement in this embodiment of the invention is in the form of light emitting diodes (LEDs) 20 which offer improved performance relative to the extremely small sized LEDs used in prior designs, the LEDs 20 of the preferred embodiment of the invention being too large to fit within the space available at the front of the connector. In order to accommodate these LEDs, the LEDs are situated at the rear of the connector in a pair of cavities 21 (only one of which is shown) cut or molded into the sidewalls 4 of the connector towards the rear wall 7 so that the LEDs can easily be inserted into the connector. While LEDs are illustrated, those skilled in the art will recognize that other types of light source may be substituted.

Each of the cavities 21 includes a main portion 22 for vertically accommodating the LED with the light exit side of the facing upward and a narrower portion 23 extending downwardly from the main portion to the lower surface 6 of the connector in order to permit insertion of the leads 24 of the LED without the need for bending or other manipulation during assembly.

In order to transmit the light from the LEDs to the front face of the connector, the preferred connector uses a light guiding arrangement made up of a light refracting surface 25 at the top of each cavity portion 22 and, optionally, a further light refracting surface made up of planar faces 26–28 projecting from, but integrally molded with, the front wall 3 of the connector housing 2 so as to cause light exiting the connector through its front face to disperse for greater visibility.

In this embodiment of the invention, the light is guided, as indicated by arrows a, b, and c, to the front of the connector by utilizing the optical properties of the connector itself, and specifically by molding surface 25 so that the light from LED 20 refracts at a sufficient angle to be directed to the front of the connector, travelling through the transparent connector body without the need for additional optical components. This arrangement optimizes both the number of parts required (only the LED itself is added to the connector is order to achieve an indicator light arrangement) and the number of assembly steps (one-placement of the LED in the connector).

Figure 4:
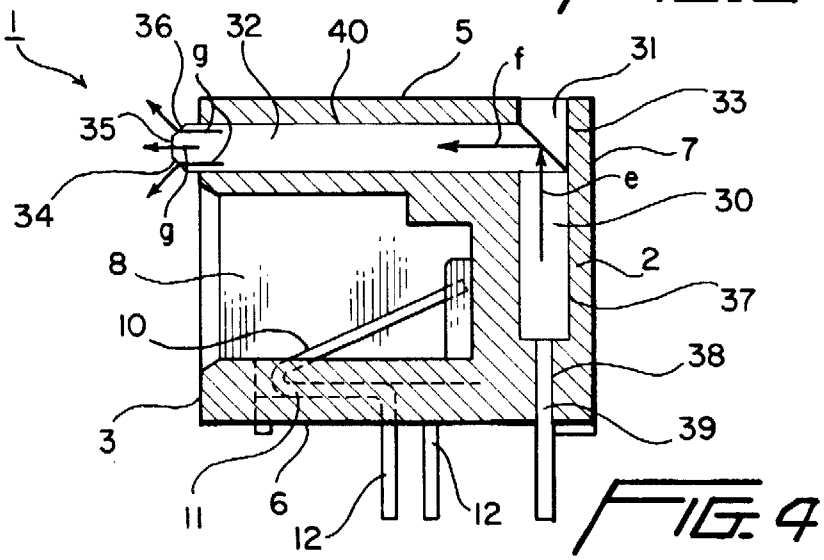
FIG. 4 is a cross-sectional side view of the connector shown in FIG. 3.
Figure 3:
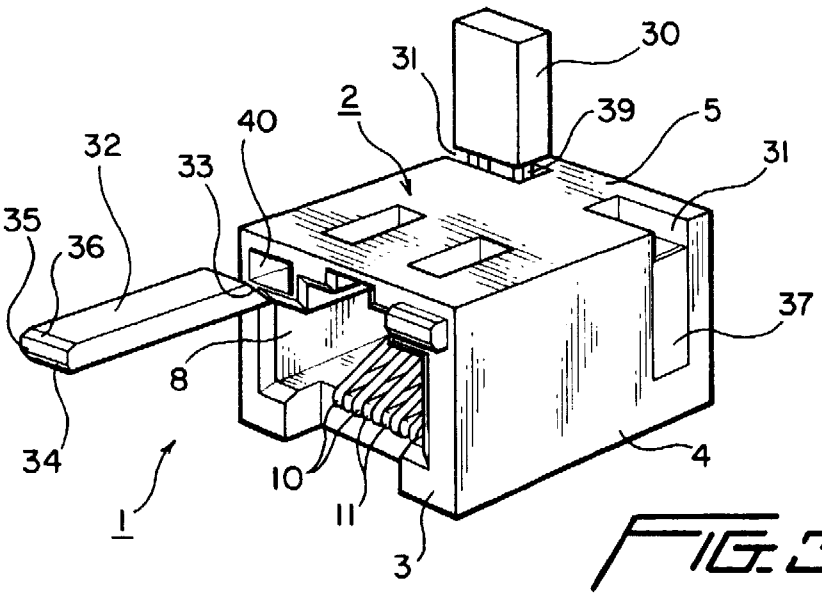
FIG. 3 is a perspective view of an RJ connector provided with discrete light guides in accordance with the principles of a second preferred embodiment of the invention.

The connector shown in FIGS. 3 and 4 is identical to that shown in FIGS. 1 and 2, except that this connector is made of an opaque material, with the light being guided from LEDs 30 placed in cavities 31 cut or molded into sidewalls 4 at the rear of the connector by a light waveguide 32 having at its rear a reflective surface 33 oriented at a 45° angle relative to the direction at which light exits the LED, as indicated by arrows e, f, and g. Optionally, the front of waveguide 32 may also include a plurality of planar faces 34–36 oriented at different directions to disperse light exiting the connector for improved visibility. The principle advantage of this embodiment over the first preferred embodiment of the invention is that the waveguides 32 in general will provide more efficient transmission of light from a corresponding LED to the front of the connector, although the cost of this embodiment may be higher as a result of the extra part required.

In this embodiment of the invention, the LED accommodating portion 37 of cavities 31 are exposed at the top surface 5 of the connector and passages 38 extending from the main portion 37 of cavities 31 to the lower surface 6 of the connector so as to provide passage for LED leads 39 are not exposed at the sidewalls 4 of the connector. However, those skilled in the art will appreciate that the cavity arrangement shown in FIGS. 1 and 2 would be equally suitable in this embodiment, and the cavity arrangement of this embodiment, in which the LEDs are inserted into the connector from the top, could also be used in the first embodiment of the invention. In addition, passages 40 for accommodating waveguides 32 are illustrated as being open only at the front face 3 of the connector and at the intersection with cavities 31, although the openings could also be exposed at the side or top of the connector for facilitating assembly or replacement.

Although two preferred embodiments of the invention have been described with sufficient particularity to enable a person skilled in the art to make and use the invention without undue experimentation, it will be appreciated that numerous other variations and modifications of the illustrated embodiments, in addition to those already noted above, may be made by those skilled in the art. For example, the diffracting surface 25 illustrated in FIGS. 1 and 2 may be replaced by a reflective surface placed at an angle which is similar to the surface 33 shown in FIGS. 3 and 4, or the reflective surface 33 shown in FIGS. 3 and 4 may be replaced by a diffractive surface oriented in a manner similar to surface 25 shown in FIGS. 1 and 2. Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

I claim:

1. In a connector, comprising:

a housing;

at least one electrical connector contact positioned in the housing; and at least one indicator light, the improvement wherein:

the indicator light is positioned at a rear portion of the housing which is remote from a face of the housing through which the light is to be viewed, and wherein the connector further comprises discrete light guide means for guiding light from the indicator light to said face, wherein the housing is made of a transparent material and the indicator light is positioned such that light from the indicator light travels through said rear portion to reach said face, and wherein the indicator light is positioned in a cavity extending parallel to said face and said light guide means comprises an end portion engaged with a top surface of said cavity, said end portion being at an angle relative to the indicator light to cause light emitted by the indicator light to be diffracted towards said face of the housing.

2. A connector as claimed in claim 1, wherein said cavity is exposed at sides of the connector to facilitate insertion of the indicator light into the connector.

3. A connector as claimed in claim 1, wherein said cavity has extending transversely therefrom passages for accommodating leads of the indicator light without bending of the leads.

4. A connector as claimed in claim 1, wherein said cavity is exposed at a top surface of the housing to facilitate insertion of the indicator light into the housing.

5. A connector as claimed in claim 1, wherein said cavity has extending therefrom passages for accommodating leads of the indicator light without bending of the leads.

6. In a connector, comprising:

a housing;

at least one electrical connector contact positioned in the housing; and at least one indicator light, the improvement wherein:

the indicator light is positioned at a rear portion of the housing which is remote from a face of the housing through which the light is to be viewed, and wherein the connector further comprises discrete light guide means for guiding light from a rear portion of said housing to said face, wherein the housing is made of a transparent material and the indicator light is positioned such that light from the indicator light travels through said rear portion to reach said face, and the discrete light guide means has an angled surface at one end for causing said light to be directed towards said face and a second end of the discrete light guide means has planar surfaces molded at different angles into said face so as to cause light exiting said face after travelling through said transparent material from said rear portion of the connector to disperse and facilitate visibility.

7. In a connector, comprising:

a housing;

at least one electrical connector contact positioned in the housing; and at least one indicator light, the improvement wherein:

the indicator light is positioned at a rear portion of the housing which is remote from a face of the housing through which the light is to be viewed, wherein the connector further comprises discrete light guide means for guiding light from the indicator light to said face, wherein said discrete light guide means is a discrete waveguide positioned in a passage extending between said face and the indicator light is positioned in a cavity which communicates with said passage to allow light from the indicator light to enter the waveguide, and wherein said waveguide includes a portion having an angled surface for causing light emitted by the indicator light to be reflected towards said face.

* * * * *